US008684505B2

(12) United States Patent
Campbell-Brown et al.

(10) Patent No.: US 8,684,505 B2
(45) Date of Patent: Apr. 1, 2014

(54) VENT PATH FOR A LIQUID CONTAINER

(71) Applicant: Hewlett-Packard Development Company, L.P., Houston, TX (US)

(72) Inventors: Iain Campbell-Brown, Leixlip (IE); William Scott Osborne, Camas, WA (US); Eugene Cahill, Leixlip (IE); Ivor Cummins, Leixlip (IE); Anoop Haridasan, Leixlip (IE)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/626,686

(22) Filed: Sep. 25, 2012

(65) Prior Publication Data

US 2013/0242011 A1 Sep. 19, 2013

Related U.S. Application Data

(63) Continuation-in-part of application No. PCT/US2012/029608, filed on Mar. 19, 2012.

(51) Int. Cl.
*B41J 2/175* (2006.01)
*B41J 2/14* (2006.01)

(52) U.S. Cl.
USPC ..... 347/86; 347/49

(58) Field of Classification Search
USPC ..... 347/7, 49, 85, 86, 87
See application file for complete search history.

(56) References Cited

U.S. PATENT DOCUMENTS

| | | | | |
|---|---|---|---|---|
| 4,806,032 | A | 2/1989 | Gragg et al. | |
| 5,877,795 | A | 3/1999 | Gragg et al. | |
| 6,055,003 | A * | 4/2000 | Hawkins et al. | 346/140.1 |
| 6,250,750 | B1 | 6/2001 | Miyazawa et al. | |
| 6,283,576 | B1 | 9/2001 | Premnath et al. | |
| 6,361,159 | B1 * | 3/2002 | Chino | 347/86 |
| 6,733,115 | B2 | 5/2004 | Santhanam et al. | |
| 6,739,708 | B2 | 5/2004 | Studer et al. | |
| 6,905,198 | B2 | 6/2005 | Studer et al. | |
| 7,258,434 | B2 | 8/2007 | Smith et al. | |
| 7,380,920 | B2 * | 6/2008 | Sonnichsen et al. | 347/84 |
| 7,445,323 | B2 | 11/2008 | Anderson, Jr. et al. | |
| 8,002,398 | B2 | 8/2011 | Pearson et al. | |
| 2005/0029306 | A1 | 2/2005 | Brennan | |
| 2010/0013897 | A1 | 1/2010 | Sulser et al. | |
| 2010/0283822 | A1 | 11/2010 | Arnold et al. | |
| 2011/0050820 | A1 | 3/2011 | Foster et al. | |

FOREIGN PATENT DOCUMENTS

WO WO-2005053960 6/2005

* cited by examiner

*Primary Examiner* — Anh T. N. Vo
(74) *Attorney, Agent, or Firm* — Steven R. Ormiston

(57) ABSTRACT

In one example, a structure for supporting a printhead includes: a substrate having a first side and a second side; multiple inlets each protruding from the first side of the substrate through which liquids may be introduced into the structure from the outlets of liquid containers that can be attached to the structure; multiple openings through the substrate from the first side to the second side, each opening positioned near one of the inlets at a location exposed to the outlet of a corresponding one of the containers when the container is attached to the structure; and an air channel on the second side of the substrate connecting each of one or more of the openings to another opening.

15 Claims, 12 Drawing Sheets

VENT PATH FOR A LIQUID CONTAINER

CROSS REFERENCE TO RELATED APPLICATIONS

This is a continuation-in-part of international patent application number PCT/US2012/029608 filed 19 Mar. 2012 titled Vent Through A Printhead Support Structure.

BACKGROUND

In some inkjet printers, the printheads are part of a discrete assembly separate from detachable ink containers in which ink is held in a block of foam or other capillary material. The ink holding chamber in these foam based ink containers is vented to the atmosphere through an opening in the top of the container.

DRAWINGS

The same part numbers designate the same or similar parts throughout the figures.

DESCRIPTION

The ink holding chamber in foam based ink containers is vented to the atmosphere through an opening in the top of the container. The container vent opening is sealed during storage and shipment to prevent evaporation from the ink chamber. The container vent is sometimes not functional when the container is installed in a printhead assembly, for example if the user fails to remove the tape sealing the vent or if there is a defect in the vent that prevents air from reaching the ink chamber inside the container. The printer will not print properly with a malfunctioning container vent. A new vent path through the printhead assembly has been developed as an addition to the conventional vent on a detachable ink container. In one example, the new vent path connects each container to the vent on another container so that each container can still supply ink even if the vent on the container malfunctions. This new vent path helps minimize ink vapor losses by providing alternative venting for each container without adding a separate path to the atmosphere.

Although examples of the new vent path are described with reference to ink containers for an inkjet printer, examples are not limited to ink containers, inkjet printers or inkjet printing. Examples of the new vent path might also be implemented in other inkjet type dispensers. The examples shown in the figures and described below, therefore, illustrate but do not limit the invention, which is defined in the Claims following this Description.

As used in this document, "liquid" means a fluid not composed primarily of a gas or gases; and a "printhead" means that part of an inkjet printer or other inkjet type dispenser that dispenses liquid from one or more openings, for example as drops or streams.

Figure 1:
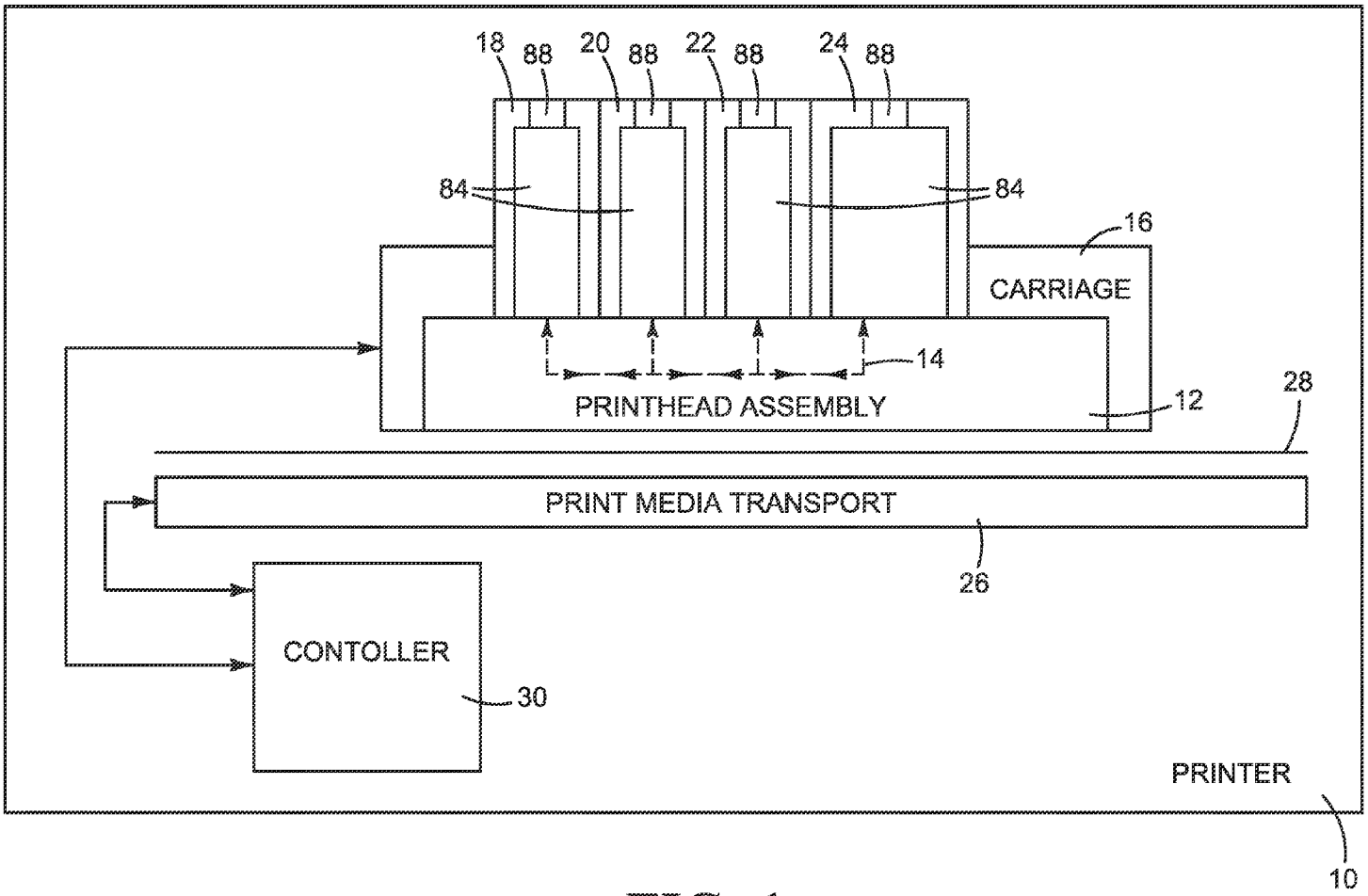
FIG. 1 is a block diagram illustrating an inkjet printer with a printhead assembly implementing one example of a new container vent path.

FIG. 1 is a block diagram illustrating an inkjet printer 10 with a printhead assembly 12 implementing one example of a new container vent path 14. FIGS. 2-9 Illustrate in detail one example of a printhead assembly 12 with a vent path 14 such as might be used in the printer shown in FIG. 1. Referring first to FIG. 1, printer 10 includes a carriage 16 carrying printhead assembly 12 and detachable ink containers 18, 20, 22, and 24 that supply ink to printhead assembly 12. Printhead assembly 12 includes one or more printheads through which ink from one or more containers 18-24 is ejected. A print media transport mechanism 26 advances a sheet of paper or other print media 28 past carriage 16 and printhead assembly 12. A controller 30 is operatively connected to carriage 16, printhead assembly 12 and media transport 26. Controller 30 represents generally the programming, processor and associated memory, and the electronic circuitry and other components needed to control the operative elements of printer 10.

The interior, ink holding chamber 84 of each container 18-24 is vented to the atmosphere through an opening 88 in the respective container 18-24. Vent path 14 in printhead assembly 12 connects the ink holding chamber 84 in each container 18-24 to the ink holding chamber 84 in each of the other containers 18-24. Accordingly, because each ink holding chamber 84 is vented through a container opening 88, vent path 14 provides an alternative vent path for each ink holding chamber 84. In the example shown, vent path 14 provides the ink holding chamber 84 in each container 18-24 with three alternative vent paths—a vent path 14 to each of the other three container vent openings 88 (through the corresponding ink chamber 84). Other configurations for vent path 14 are possible. For example, one or more separate vent paths 14 may connect a container ink chamber 84 to fewer than all of the other container vent openings 88 (through the corresponding container ink chamber 84).

Figure 2:
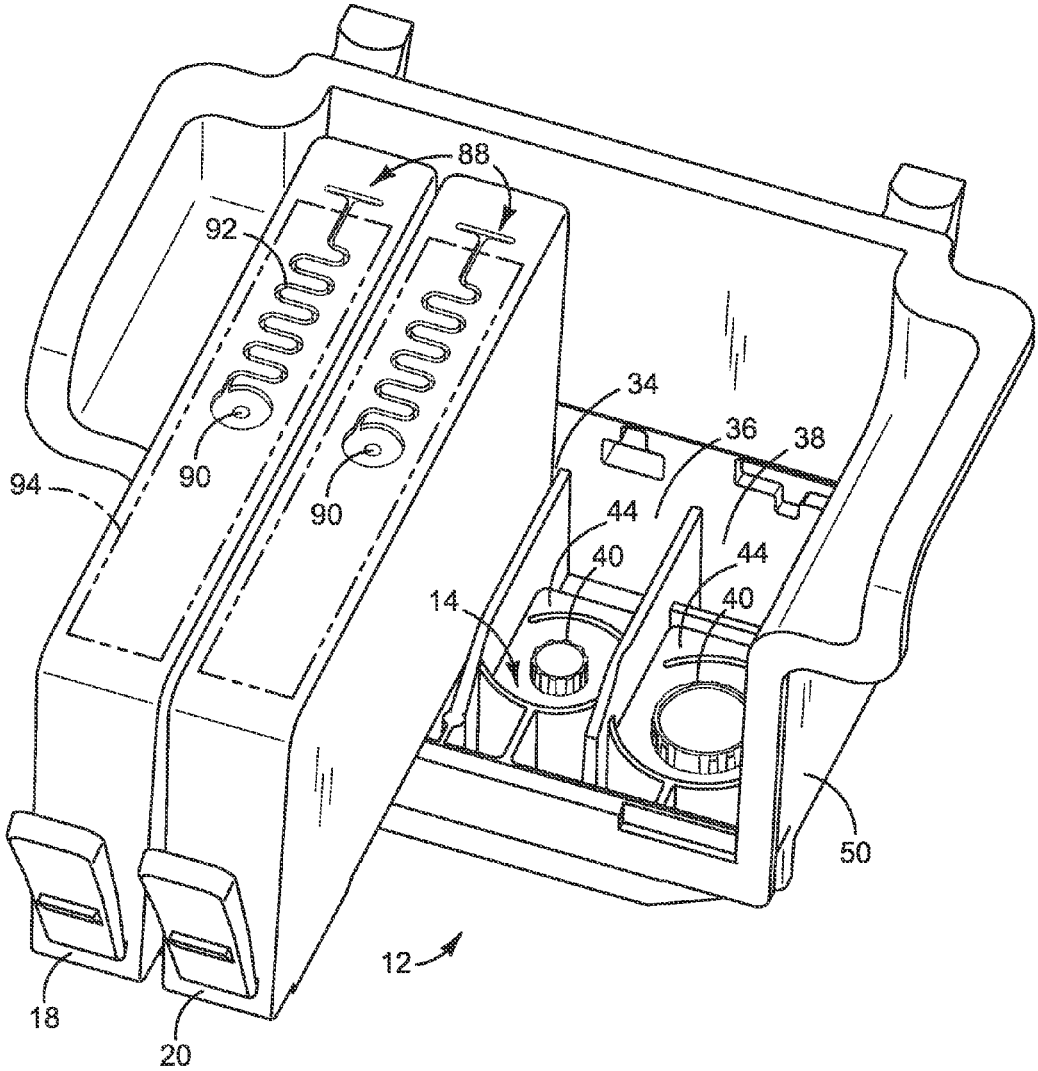
FIGS. 2 and 3 are perspective views illustrating a printhead assembly implementing one example of a new container vent path.
Figure 3:
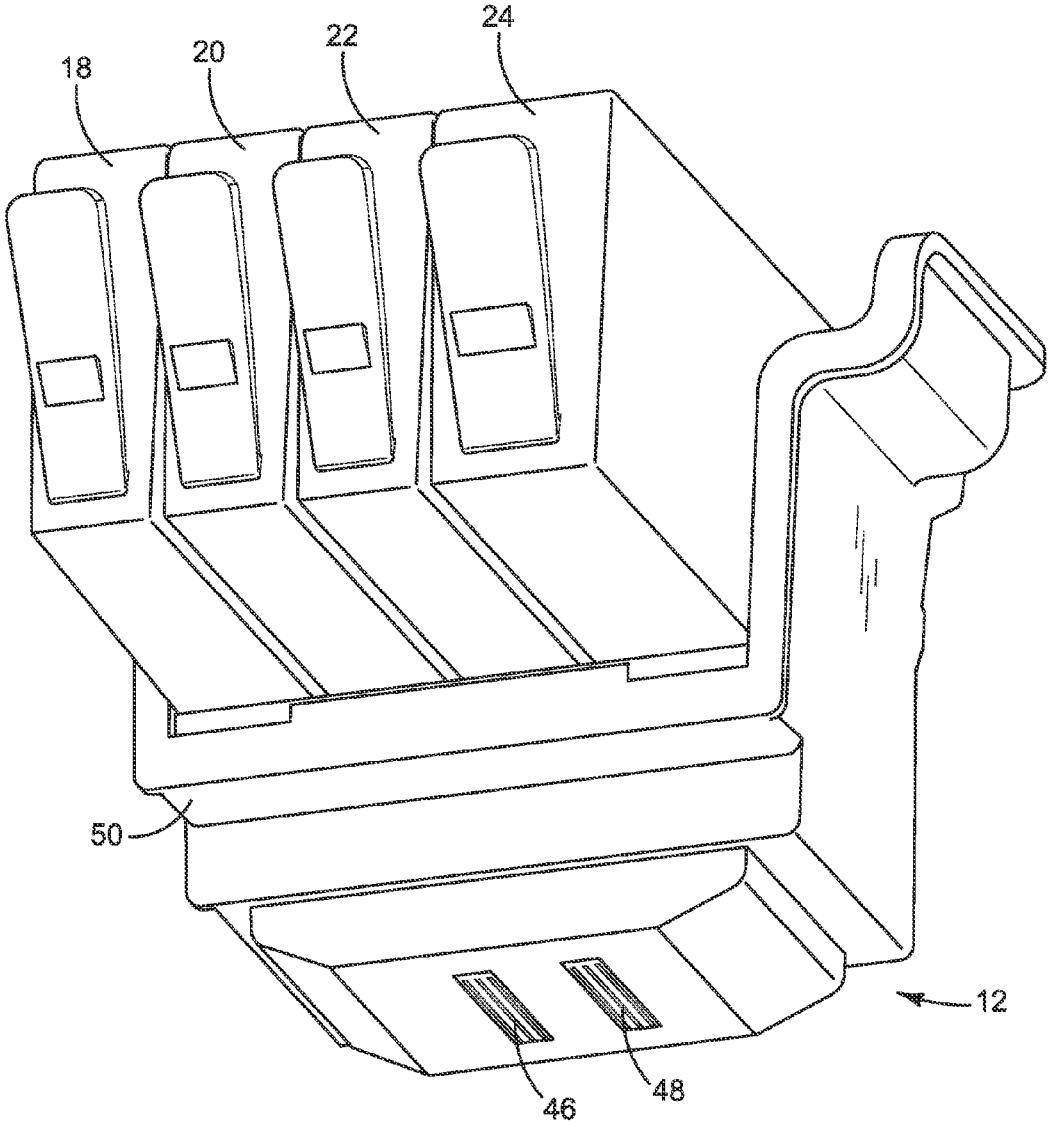

Referring now to FIGS. 2 and 3, printhead assembly 12 includes bays 32, 34, 36, and 38 for receiving detachable ink containers 18-24, respectively. (Bay 32 is visible in FIG. 4.) Only ink containers 18 and 20 are shown installed in printhead assembly 12 in FIG. 2 to better illustrate some features of printhead assembly 12. Printhead assembly 12 includes ink inlets 40 for receiving ink from a corresponding ink outlet 42 (visible in FIGS. 8 and 9) on each detachable ink container 18-24. Each ink inlet 40 is configured as a tower that is surrounded by an annular seal 44 that seals against the bottom of each container outlet when the container is installed in printhead assembly 12. In the example shown, printhead assembly 12 includes two printheads 46 and 48. Ink from color ink containers 18-22, for example, is ejected from printhead 46 and ink from a black ink container 24 is ejected from printhead 48.

Figure 4:
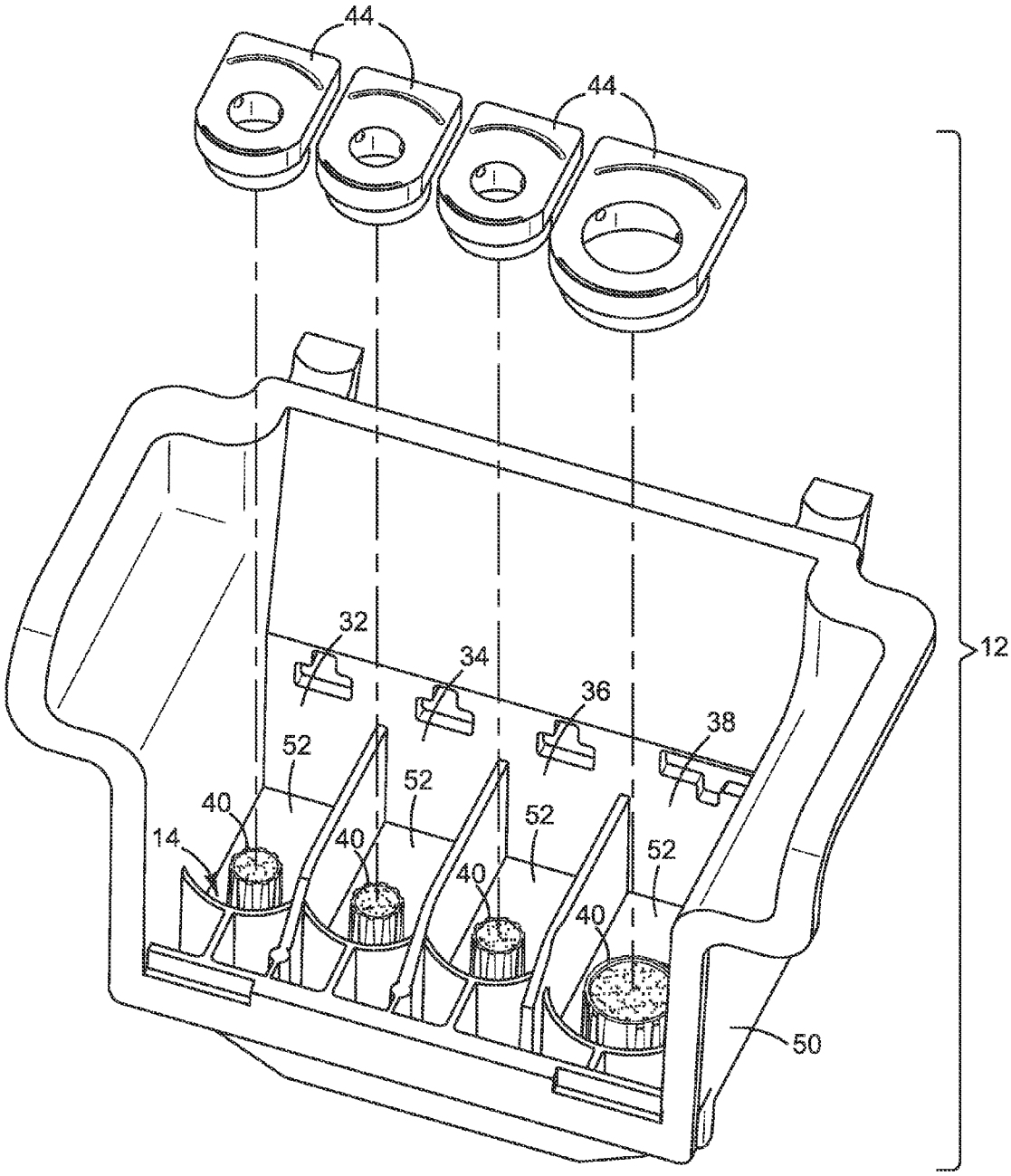
FIG. 4 is an exploded top side perspective view of the printhead assembly of FIGS. 2 and 3.
Figure 5:
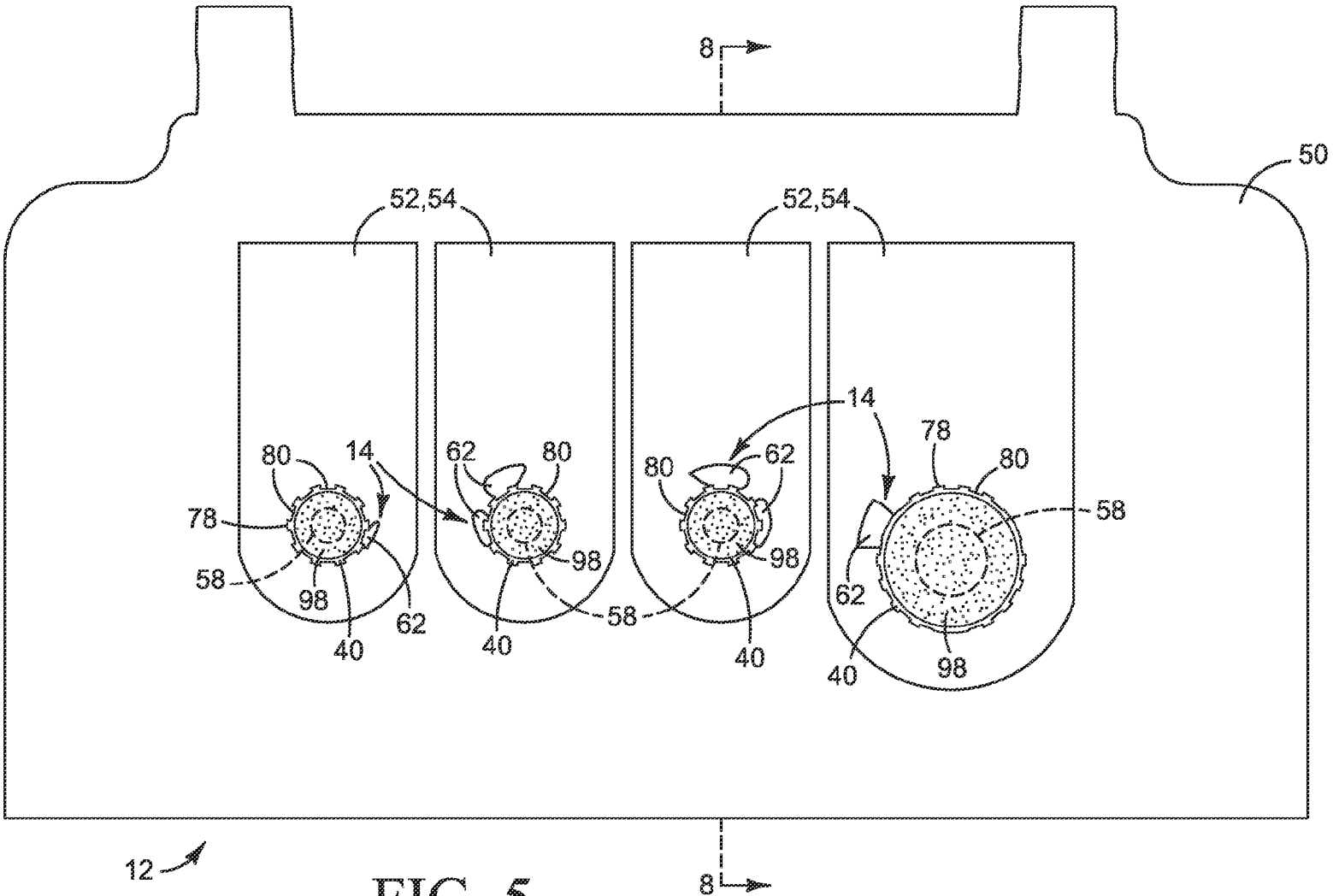
FIG. 5 is a top down plan view showing the printhead assembly of FIGS. 2-4 with the tower seals removed to expose air holes in the substrate of the printhead support structure.
Figure 6:
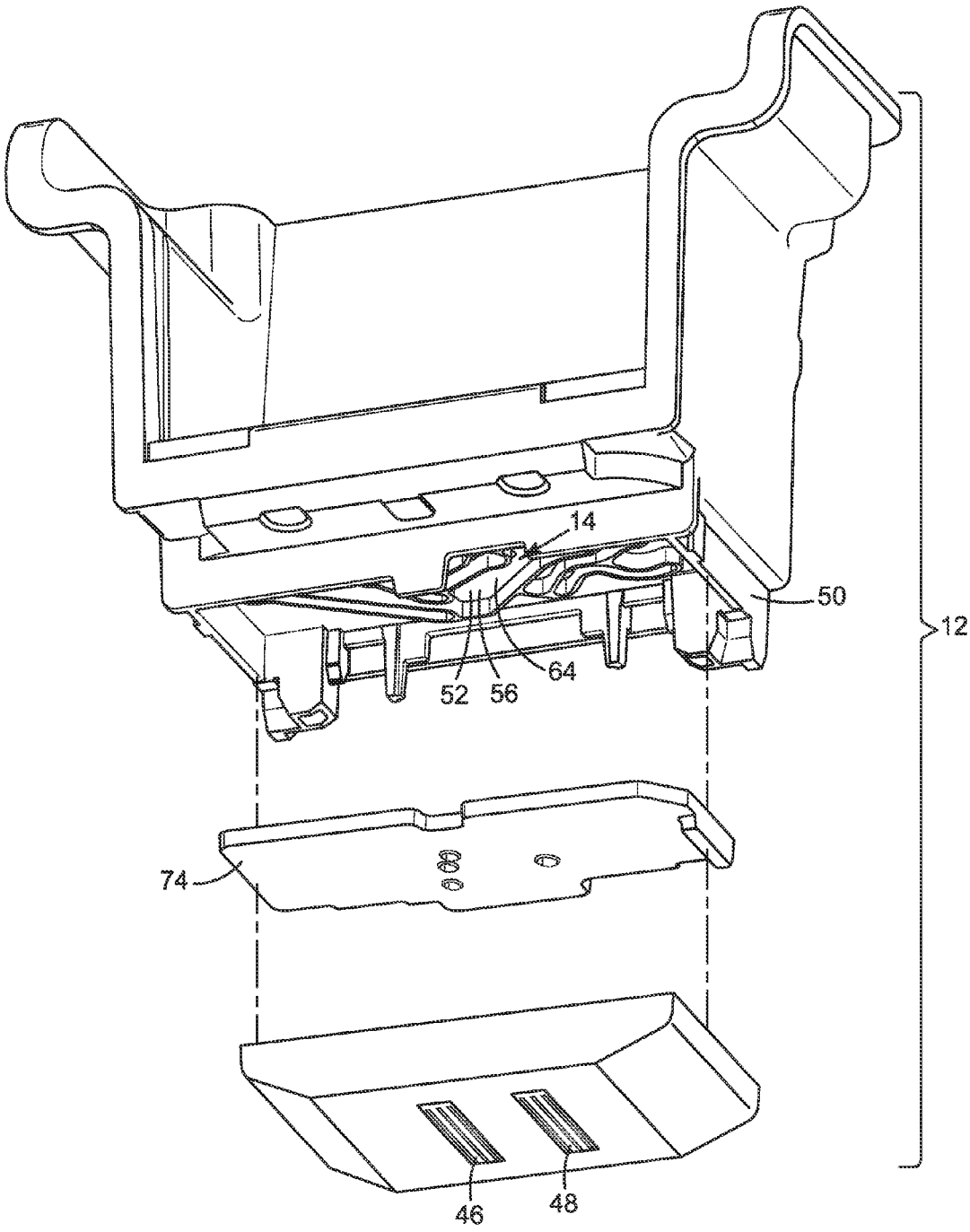
FIG. 6 is an exploded bottom side perspective view of the printhead assembly of FIGS. 2-5.
Figure 7:
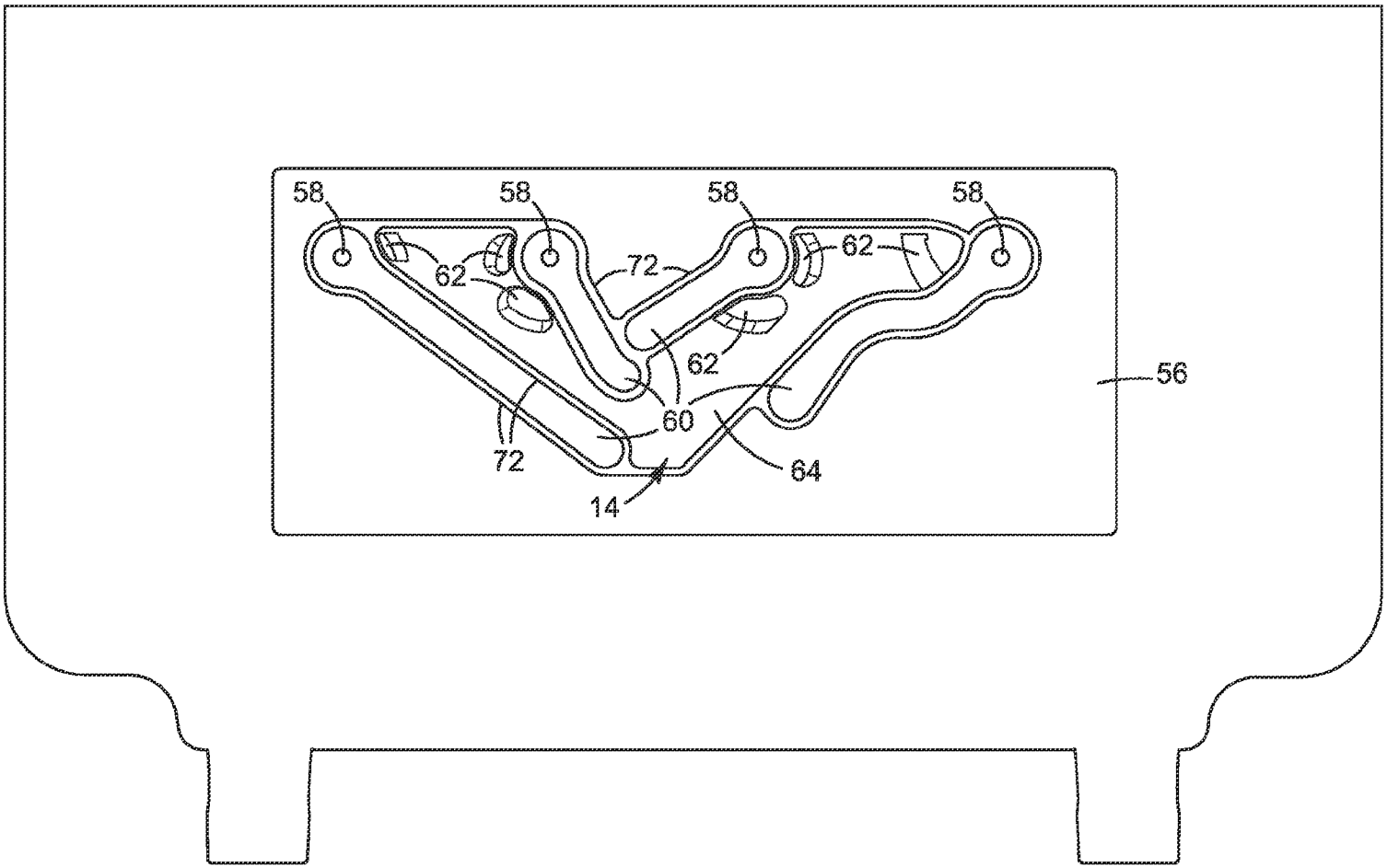
FIG. 7 is a bottom side plan view of the printhead assembly of FIGS. 2-6 with the manifold cover removed to expose the air channel along the underside of the printhead support structure substrate.
Figure 8:
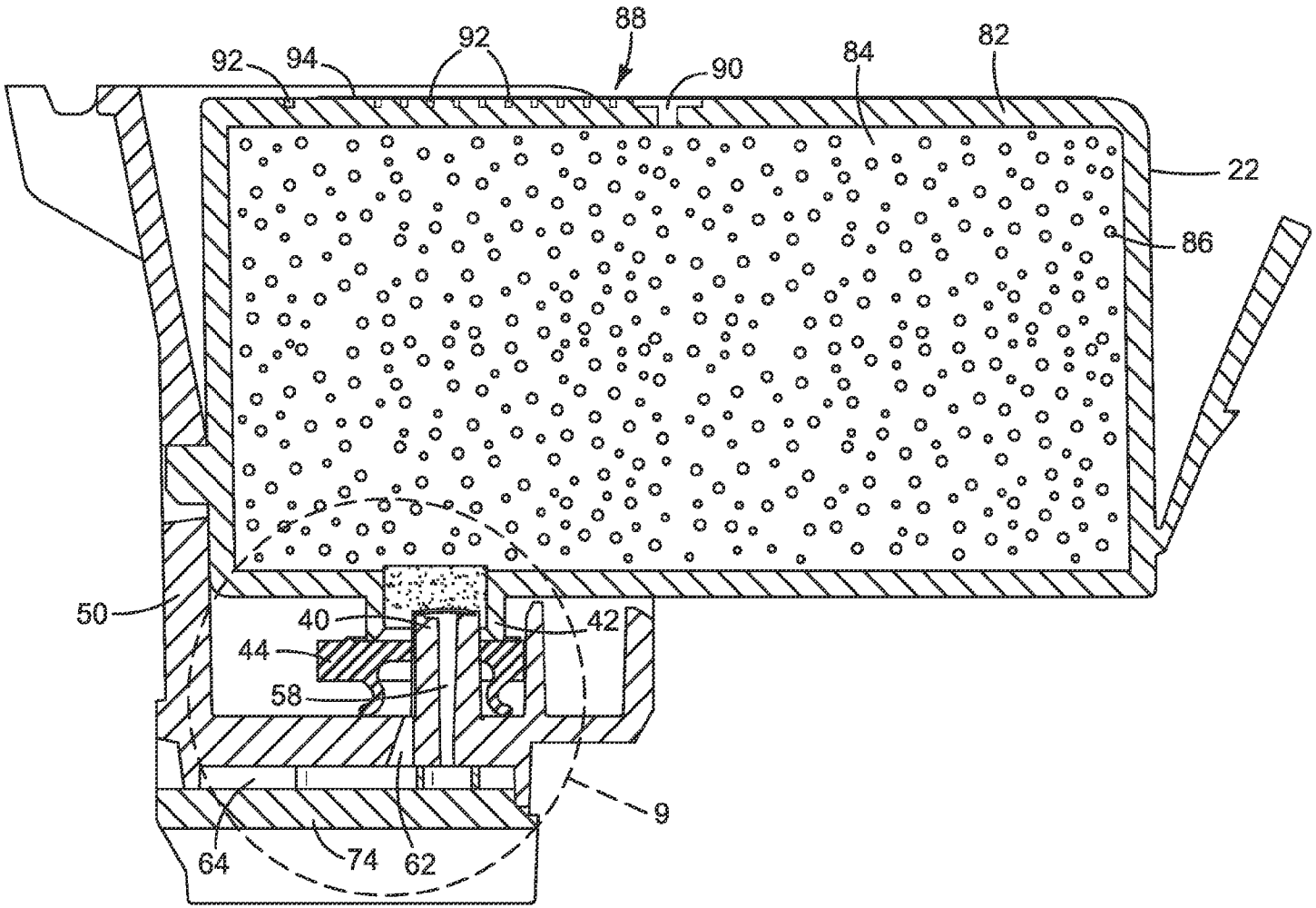
FIG. 8 is a section view of the printhead assembly of FIGS. 2-7 taken along the line 8-8 in FIG. 5 showing a vent path from the ink container outlet through the printhead assembly.
Figure 9:
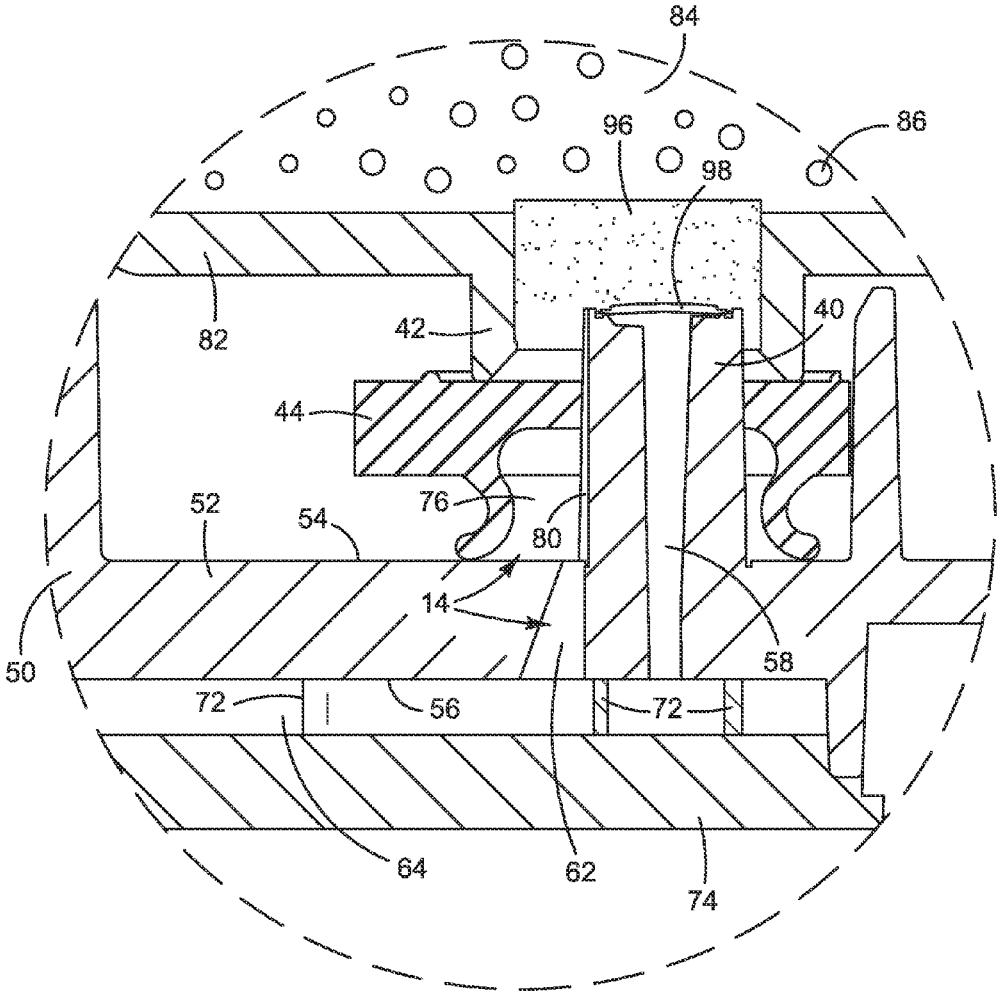
FIG. 9 is a detail view of the vent path shown in FIG. 8.

FIGS. 4 and 5 are exploded top side perspective and plan views, respectively, of printhead assembly 12. The inlet tower seals 44 are omitted in FIG. 5 to better illustrate vent path 14. FIGS. 6 and 7 are bottom side perspective and plan views, respectively, of printhead assembly 12. The printheads 46, 48 and the manifold cover are omitted in FIG. 7 to better illustrate vent path 14. FIGS. 8 and 9 are section views showing vent path 14 in more detail.

Referring to FIGS. 4-9, printhead assembly 12 includes a support structure 50 that supports printheads 46, 48 and other parts of printhead assembly 12. Ink inlet towers 40 protrude from a generally planar substrate 52 of support structure 50. While it is expected that printhead assembly 12 will usually be installed in a printer so that substrate 52 is horizontal during printing operations, as shown in the figures, a horizontal substrate 52 is not required. Indeed, substrate 52 alone or integrated into a printhead assembly 12 might have different orientations during manufacturing, packaging, storing, shipping, and printing. Ink inlet towers 40 protrude from a first side 54 of substrate 52. Printheads 46, 48 are mounted to a second side 56 of substrate 52 opposite first side 54. An ink hole 58 in substrate 52 inside each inlet tower 40 allows ink to flow through each container outlet 42 to printhead 46 or 48 along a corresponding ink channel 60 formed in the second side 56 of substrate 52.

An air hole 62 in substrate 52 near each inlet tower 40 exposes each container outlet 42 to an air channel 64 formed in the second side 56 of substrate 52. In the example shown, as best seen in FIG. 7, air channel 64 is defined by a single enclosed chamber along substrate second side 56 enveloping air holes 62. Although multiple channels 64 each connecting fewer than all of the air holes 62 might be used, a single channel 64 connecting all air holes 62 maximizes the number of alternate vent paths for each container 18-24. In the example shown, the walls 72 defining ink channels 60 and air chamber 64 are formed in second side 56 of substrate 52 and closed by a cover 74. That is to say, three sides of each enclosed space are formed in substrate 52 and the fourth side is formed by cover 74 affixed to substrate 52. Cover 74 is sometimes called a manifold cover because it helps define the ink distribution manifold formed by ink channels 60 in printhead assembly 12.

Each ink inlet tower 40 is surrounded by a seal 44. Referring specifically to FIGS. 8 and 9, the bottom of each container outlet 42 is pressed into a corresponding seal 44 to make a fluid tight seal that prevents air and ink from escaping between container outlet 42 and printhead assembly inlet 40. Seal 44 forms an interior cavity 76 surrounding at least part of inlet tower 40. Air hole 62 opens into cavity 76. The outer surface 78 of inlet tower 40 is recessed at the location of air hole 62 so that air can move from cavity 76 past seal 44 to container outlet 42. In the example shown, multiple recesses 80 are formed along outer surface 78 of inlet tower 42 to achieve the desired air flow between cavity 76 and container outlet 42.

Still referring to FIGS. 8 and 9, each ink container 18-24 includes a housing 82 that forms an interior chamber 84 for holding ink. For convenience, only ink container 22 shown in FIGS. 8 and 9 is called out in the following description. Ink in chamber 84 is held in foam or other suitable capillary material 86. A vent 88 on container 22 vents ink chamber 84 to the atmosphere. Vent 88 usually includes an opening 90 in container housing 82 and a small winding channel 92 covered by an adhesive label 94. (Label 94 is shown in phantom lines on containers 18 and 20 in FIG. 2.) A wick 96 in container outlet 42 forms the fluidic interface between ink container 22 and printhead assembly 12. When ink container 22 is installed in printhead assembly 12, as shown in FIGS. 8 and 9, wick 96 engages a corresponding inlet tower 40 on printhead assembly 12, for example through a filter 98, to establish the operative ink and air connections between ink container 22 and printhead assembly 12. Thus, vent path 14 allows air flow between ink chambers 84 through air chamber 64 to air holes 62 in substrate 52 to cavities 76 between seals 44 and inlet towers 40, past inlet towers 40 in recesses 80 to wicks 96 in container outlets 42.

When container 22 is installed in printhead assembly 12 but not vented correctly through its own vent 88, the flow of ink from container 22 into printhead assembly 12 during printing and priming can create too high a vacuum inside ink chamber 84, starving the printheads of ink. Excessive vacuum forms because ink is expelled from container 22 during printing or priming but not enough air to replace the ink can flow into container 22 through a malfunctioning container vent. Vent path 14 through printhead assembly 12 allows air from vents 88 on the other ink containers 18, 20, and 24 to pass around and through wick 96 into ink chamber 84 to maintain a correct pressure inside container 22 even if the container 22 vent fails. Air holes 62 in substrate 52 and recesses 80 along inlet tower 40 may be sized and shaped to achieve the desired venting and, where appropriate, to facilitate manufacturing. (Printhead support structure 50 usually will be a molded plastic part.) Multiple smaller air holes 62 around an inlet tower 40, as shown in FIG. 5, may be used instead of a single larger hole as necessary or desirable to maintain the rigidity of inlet tower 40 to substrate 52.

Figure 10:
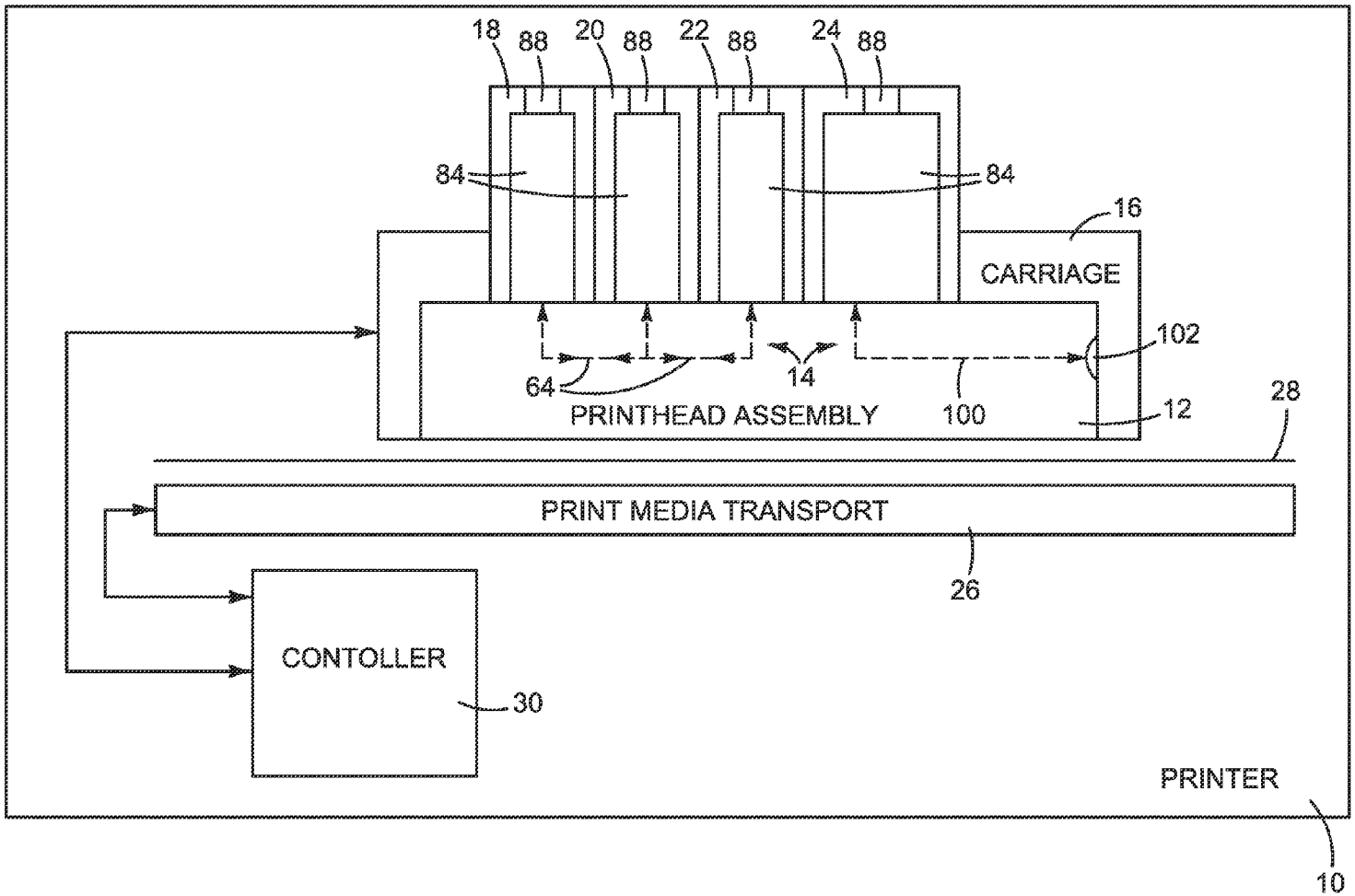
FIG. 10 is a block diagram illustrating an inkjet printer with a printhead assembly implementing another example of a new container vent path.
Figure 11:
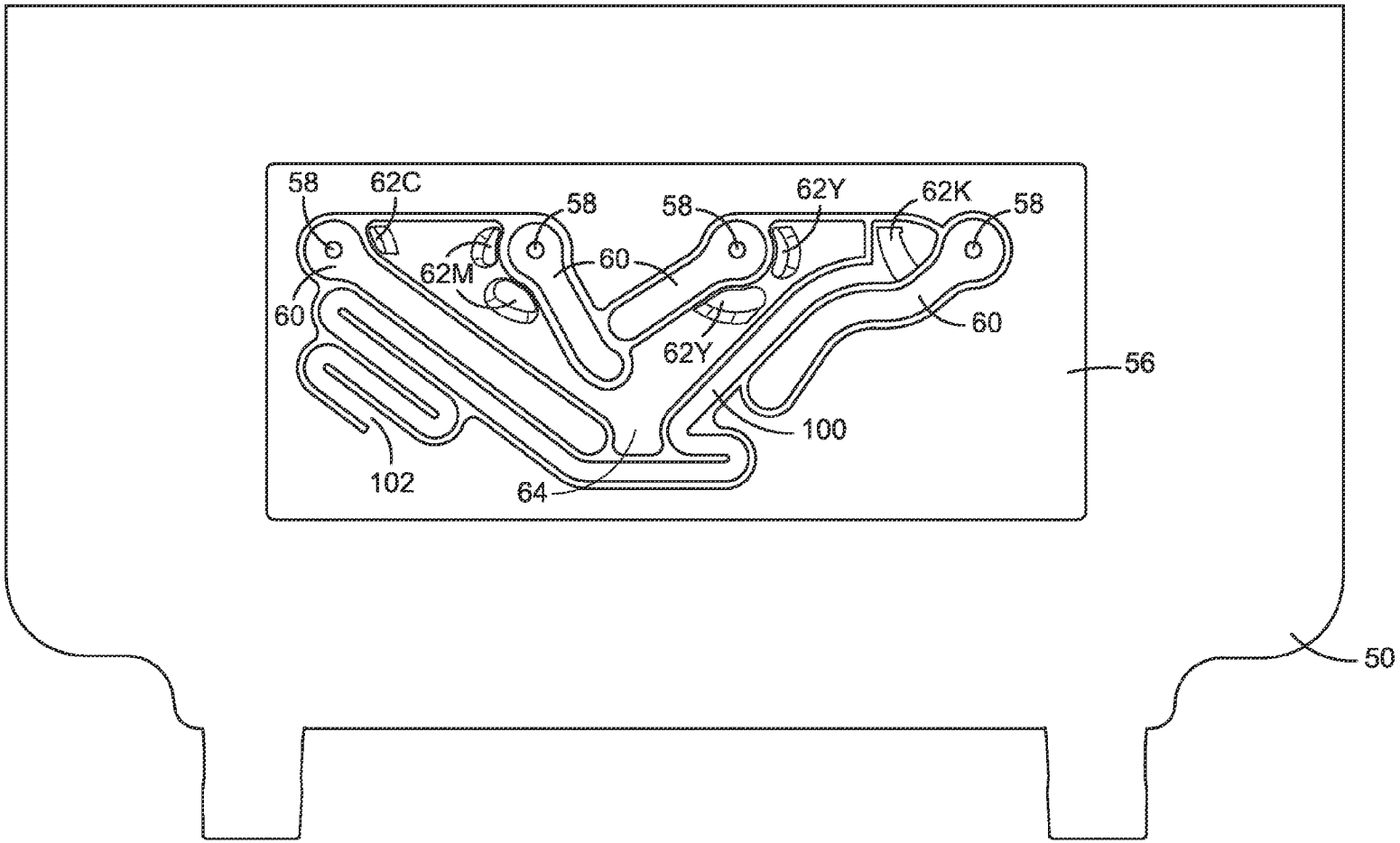
FIG. 11 is a bottom side plan view of a printhead assembly such as that shown in FIGS. 2-5 with the manifold cover removed illustrating one example implementation of the container vent path in the block diagram of FIG. 10.

In another example, shown in FIGS. 10 and 11, vent path 14 through printhead assembly 12 includes two air channels 64 and 100. First air channel 64 is defined by a single enclosed chamber along substrate second side 56 that envelopes some but not all air holes 62—air holes 62C, 62M, and 62Y in FIG. 11. The second air channel 100 vents air hole 62K (and the corresponding ink container 24) directly to the atmosphere at outlet 102, without passing through any of the other air holes 62C, 62M, 62Y. The configuration of vent path 14 in FIGS. 10 and 11 may be used, for example, to help minimize the risk of cross-contamination between different types of ink. It has been observed that ink condensation may form on surfaces exposed to air chamber 64. If the black ink and the color inks have different chemistries, pigment and dye based inks, for example, a single air channel 64 common to both types of ink might allow black pigment to condense on color dye based ink structures, possibly causing undesirable effects within printhead assembly 12. Accordingly, a black (K) ink container 24 may benefit from a direct vent channel 100. Although FIGS. 10 and 11 show a printhead assembly vent path 14 in which three of four ink containers are vented through one another and the fourth ink container is vented directly to the atmosphere, other configurations are possible.

Figure 12:
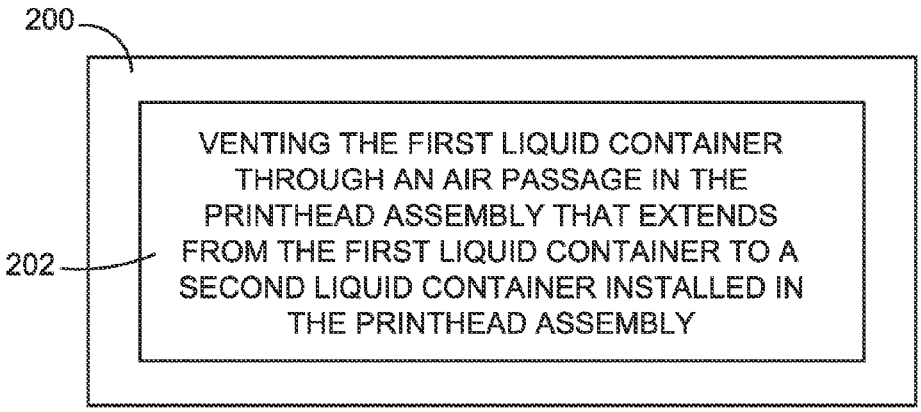
FIGS. 12-14 are block diagrams illustrating example methods for venting a liquid container through a printhead assembly.
Figure 13:
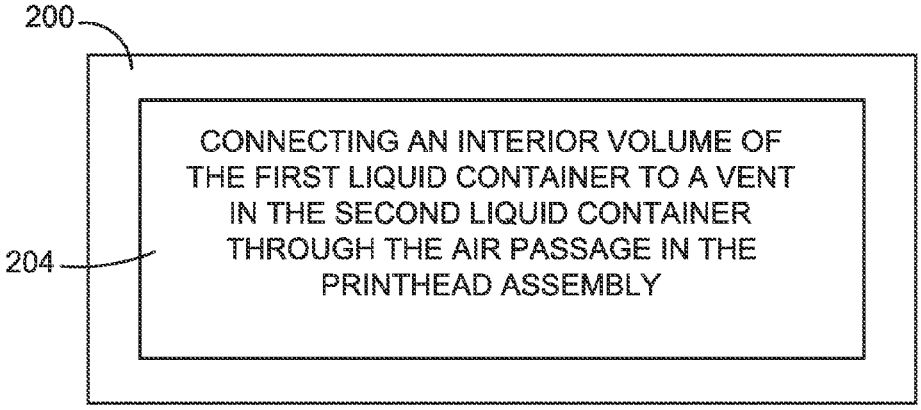
Figure 14:
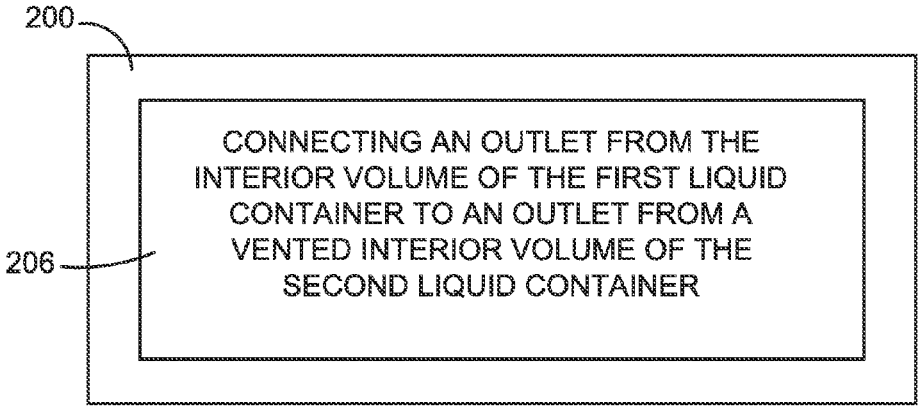

In another example, and referring to the block diagram of FIG. 12, a method 200 for venting a first ink or other liquid container installed in a printhead assembly includes venting the first liquid container through an air passage in the printhead assembly that extends from the first liquid container to a second liquid container installed in the printhead assembly (block 202). In one specific implementation shown in FIG. 13, the venting 202 is performed by connecting an interior volume of the first liquid container to a vent in the second liquid container through the air passage in the printhead assembly (block 204). In one specific implementation shown in FIG. 14, the connecting 204 is performed by connecting an outlet from the interior volume of the first liquid container to an outlet from a vented interior volume of the second liquid container (block 206).

As noted at the beginning of this Description, the examples shown in the figures and described above illustrate but do not limit the invention. Other examples are possible. Therefore, the foregoing description should not be construed to limit the scope of the invention, which is defined in the following claims.

What is claimed is:

1. A structure for supporting a printhead, comprising:

a substrate having a first side and a second side;

multiple inlets each protruding from the first side of the substrate through which liquids may be introduced into the structure from outlets of liquid containers that can be attached to the structure;

multiple openings through the substrate from the first side to the second side, each opening positioned near one of the inlets at a location exposed to the outlet of a corresponding one of the containers when the container is attached to the structure; and a first air channel on the second side of the substrate connecting each of one or more of the openings to another opening.

2. The structure of claim 1, wherein the first air channel comprises a single chamber enveloping the connected openings on the second side of the substrate.

3. The structure of claim 2, wherein the chamber connects each opening to all of the other openings.

4. The structure of claim 2, further comprising a second air channel on the second side of the substrate connecting one or more of the openings to the atmosphere without passing through any of the other openings.

5. The structure of claim 1, further comprising:

a seal surrounding each inlet to seal the outlet of a liquid container against the structure, each seal forming a cavity surrounding the inlet on the first side of the substrate and each opening into a corresponding one of the cavities; and a gap between the seal and the inlet to allow air to pass between the cavity and a container outlet.

6. The structure of claim 5, wherein each gap comprises multiple gaps formed by a series of recesses in an outer surface of the inlet at an interface with the seal.

7. A printhead assembly, comprising:

a printhead to dispense liquid; and a structure supporting the printhead, the structure including:

multiple liquid inlets each to receive liquid from a corresponding one of multiple liquid containers that may be attached to the printhead assembly;

a liquid manifold to distribute liquid from the inlets to the printhead; and a vent path therein that allows air to pass between first and second liquid containers when the containers are attached to the printhead assembly.

8. The printhead assembly of claim 7, wherein the vent path also vents a third liquid container directly to the atmosphere without air passing between the third container and another container when the containers are attached to the printhead assembly.

9. The printhead assembly of claim 7, wherein the vent path extends from an opening into each container when the containers are attached to the printhead assembly to a single, sealed air chamber that connects all of the openings.

10. The printhead assembly of claim 7, further comprising a substrate having a first side and a second side opposite the first side, and wherein:

each inlet comprises an inlet tower protruding from the first side of the substrate;

the manifold comprises multiple liquid channels along the second side of the substrate, each liquid channel connected to a corresponding inlet tower through a liquid opening in the substrate; and the vent path comprises multiple air openings through the substrate each near a corresponding inlet tower and a sealed air channel along the second side of the substrate connecting two or more of the air openings.

11. The printhead assembly of claim 10, wherein the air channel comprises a single air channel connecting each air opening to all of the other air openings.

12. A method of venting a first liquid container installed in a printhead assembly, the method comprising venting the first liquid container through an air passage in the printhead assembly that extends from the first liquid container to a second liquid container installed in the printhead assembly.

13. The method of claim 12, wherein the venting comprises connecting an interior volume of the first liquid container to a vent in the second liquid container through the air passage in the printhead assembly.

14. The method of claim 13, wherein the connecting comprises connecting an outlet from the interior volume of the first liquid container to an outlet from a vented interior volume of the second liquid container.

15. The method of claim 12, further comprising dispensing a liquid from the first container through the printhead assembly while venting the first container through the second container.

* * * * *